US007137913B2

(12) United States Patent
Page et al.

(10) Patent No.: US 7,137,913 B2
(45) Date of Patent: Nov. 21, 2006

(54) END CONFIGURATION FOR A BASEBALL BAT

(75) Inventors: Christopher S. Page, Portland, OR (US); Leonard W. Brownlie, West Vancouver (CA); Peter M. Ostafichuk, Vancouver (CA)

(73) Assignee: Nike International Ltd., Beaverton, OR (US)

( * ) Notice: Subject to any disclaimer, the term of this patent is extended or adjusted under 35 U.S.C. 154(b) by 0 days.

(21) Appl. No.: 10/949,058

(22) Filed: Sep. 23, 2004

(65) Prior Publication Data

US 2006/0063620 A1 Mar. 23, 2006

(51) Int. Cl.
*A63B 59/06* (2006.01)

(52) U.S. Cl. ..... 473/566

(58) Field of Classification Search ..... 473/457, 473/564–568, 519, 520

See application file for complete search history.

(56) References Cited

U.S. PATENT DOCUMENTS

| | | | | |
|---|---|---|---|---|
| 771,247 | A | 10/1904 | Hillerich | |
| 1,530,427 | A | 3/1925 | Simon | |
| 2,169,774 | A * | 8/1939 | Taylor | 473/564 |
| 3,727,295 | A | 4/1973 | Gildemeister | |
| 3,811,596 | A | 5/1974 | Wilson | |
| 4,763,900 | A | 8/1988 | Carr | |
| 5,284,332 | A * | 2/1994 | DiTullio | 473/564 |
| 5,421,572 | A | 6/1995 | MacKay, Jr. | |
| 5,494,280 | A | 2/1996 | MacKay, Jr. | |
| 5,511,777 | A * | 4/1996 | McNeely | 473/520 |
| 5,785,614 | A | 7/1998 | MacKay, Jr. | |
| 5,785,617 | A | 7/1998 | MacKay, Jr. | |
| 5,931,750 | A * | 8/1999 | MacKay, Jr. | 473/566 |
| 5,954,602 | A | 9/1999 | Eggiman | |
| 6,334,825 | B1 | 1/2002 | Buiatti | |
| 6,432,007 | B1 | 8/2002 | Filice | |
| 6,482,110 | B1 | 11/2002 | Ogg | |

FOREIGN PATENT DOCUMENTS

| | | |
|---|---|---|
| CA | 2069730 | 11/1993 |
| JP | 09299526 A * | 11/1997 |

OTHER PUBLICATIONS

Image of bat end cap; presumed to be known in United States prior to Sep. 23, 2004, 1 page.

* cited by examiner

*Primary Examiner*—Mark S. Graham
(74) *Attorney, Agent, or Firm*—ipsolon llp

(57) ABSTRACT

An end configuration for a bat includes in one embodiment an end cap that has a base that is shaped to fit within the open end of the bat thereby to attach the end cap to the bat. The end cap also includes a convexly contoured end surface that is exposed when the end cap is attached to the bat. The end surface is roughened to reduce the aerodynamic drag when the bat is swung, thereby to increase the momentum of the bat for a given amount of force applied to swing the bat.

21 Claims, 5 Drawing Sheets

END CONFIGURATION FOR A BASEBALL BAT

TECHNICAL FIELD

This invention relates to an end configuration for a baseball bat. The configuration reduces aerodynamic drag that acts on the bat when the bat is swung.

BACKGROUND

It is well known that a baseball bat is used for striking a ball during the game of baseball. The bat may be used with a conventional hardball or with a larger ball that is known as a softball. For the purposes of this description, the terms bat, ball, and baseball are used in their generic sense, and the invention described below may be adapted for use in any sport where an elongated member such as a bat is swung for the purpose of striking an object such as a ball.

The action of striking a baseball with a bat changes the momentum of the ball. Much of the momentum of the bat is thus transferred to the ball.

The momentum of the swung bat is the product of the mass of the bat and its velocity. The velocity of the bat primarily depends upon how much force a batter applies to the bat during the swing. It is helpful to think of the force applied to the bat by the batter as a "swinging force."

Aerodynamic drag is a force that resists the swinging force. The magnitude of the drag force depends in part upon how fast the bat is swung or, more precisely, upon the relative speed of the bat through the air. The drag force has two components. One component is known as "pressure drag" or "form drag." Pressure drag is caused by the pressure difference between the front or leading end of an object and the rear or trailing end of the object as that object is moved through the air. The magnitude of the pressure drag depends primarily upon the size and shape of the object, as well as the velocity of the object. A blunt object, such as a cylinder, will incur more pressure drag than a streamlined object, such as an airfoil.

It is noteworthy here that the movement of fluid (air) relative to an object such as a bat can be considered in terms of streamlines. A streamline is an imaginary line that is tangent to the direction of flow of the air. Every air particle in a streamline will follow the same direction or path around an object.

The other drag component that combines with pressure drag is known as "frictional drag" or "viscous drag." Essentially, viscous drag is present within the boundary layer of the air. The boundary layer is the thin layer of air adjacent to the surface of any object moving through air. At the surface of the object the air in contact with the surface moves with a velocity of zero relative to the surface. The upper edge of the boundary layer is where the air moves at the same velocity as the surrounding streamlines (that is, where the velocity of the air near the object is not dependent on viscous effects).

The magnitude of viscous drag is influenced in part by the state of the boundary layer. The boundary layer state may be laminar or turbulent. In a laminar boundary layer, all of the streamlines lie in approximately parallel layers and do not cross. The slowest air particles are in the streamlines or layers nearest the surface of the object, and the air particles in each higher layer move in streamlines that are faster than the one below. This pattern is termed a velocity gradient.

As a laminar boundary layer continues along a surface, the height of the boundary layer increases until it eventually undergoes a transformation to a turbulent boundary layer through a process known as transition. In a turbulent boundary layer, the flow is comprised of an average velocity gradient with many random temporal and spatial internal fluctuations. Generally, turbulent boundary layers are thicker and produce more viscous drag than laminar boundary layers.

The roughness of the surface of the object affects the state of the boundary layer (laminar or turbulent). Roughened surfaces will generally cause a laminar boundary layer to experience an earlier transition to a turbulent boundary layer.

Laminar air flow around an object will produce less viscous drag (as compared to turbulent flow), but such flow is also prone to a phenomenon called flow separation whereby the air traveling over a surface becomes detached from the surface, creating a low pressure region immediately downstream from where the flow separates from the object. Such low-pressure regions near the trailing side of an object add a significant amount of pressure drag. Turbulent-boundary-layer flow, as compared to laminar flow, is less likely to separate from an object. Accordingly, in some instances where laminar boundary layer separation is likely to occur (as with a blunt object), it is desirable to reduce flow separation by (i) contouring or streamlining the shape of the object and/or (ii) by intentionally roughening the surface of the object, thereby to induce turbulent-boundary-layer flow and eliminate or reduce pressure drag that might otherwise be produced by flow separation.

SUMMARY OF THE INVENTION

The present invention is generally directed to the reduction of aerodynamic drag that acts on a swung baseball bat. The reduction in drag, for a given swinging force, will have the effect of increasing the bat velocity, thereby increasing the momentum that is imparted to the struck ball. The ball will thus travel farther than it would when struck with a less aerodynamic (hence, lower-momentum) bat that is swung with the same force.

The present invention is adaptable for improving the aerodynamic characteristics of the bat (i.e., reduction in aerodynamic drag) without altering the surface portion of the bat (the barrel) that is intended to contact the ball, thus avoiding conflict with baseball game regulations that permit the use of only smooth-barreled bats.

Accordingly, the present invention relates specifically to a bat end configuration that embodies techniques for reducing aerodynamic drag acting on the bat. The inventive techniques can be applied to the end of a solid or one-piece bat, or provided as part of a cap that is attached to the end of a bat.

The present invention is in part based on the recognition that aerodynamic drag increases with the relative velocity of the bat in the air, and that the free end of a swinging bat is the fastest moving part of the bat. Therefore, a significant reduction in overall drag will occur when the free end of the bat is configured to minimize aerodynamic drag.

Other advantages and features of the present invention will become clear upon review of the following portions of this specification and the drawings.

BRIEF DESCRIPTION OF THE DRAWINGS

In order that the present invention may be more readily understood, embodiments thereof will now be described, by way of example, with reference to the accompanying drawings, in which.

DETAILED DESCRIPTION

Figure 1:
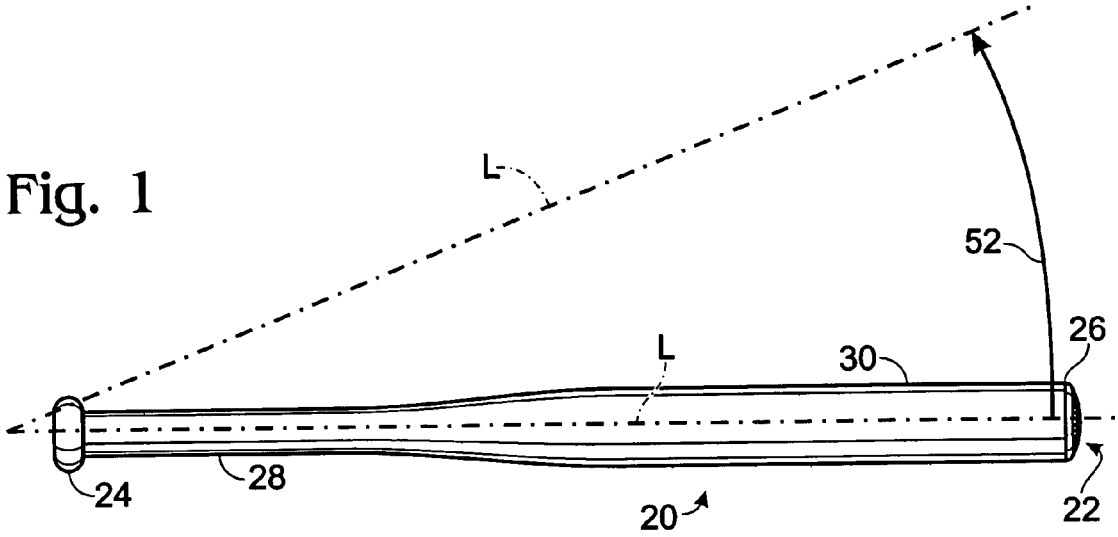
FIG. 1 is a diagram of a baseball bat that is adapted to include the end configuration of the present invention.

One preferred embodiment of the present invention is illustrated in FIGS. 1–4, which show a generally conventional baseball bat 20 (FIG. 1) with which the end configuration 22 of the present invention is adaptable. The bat has a grip end 24 and a free end 26. The grip 28 of the bat is the relatively narrow-diameter portion of the bat near the grip end 24. Between the grip 28 and the free end 26 of the bat lies the barrel 30 of the bat, which has a smooth, cylindrical outer surface, and is the portion of the bat that is intended to contact a ball.

The grip 28 is held by a batter and swung for hitting a pitched ball. The arc indicated by the arrow 52 in FIG. 1 illustrates part of the swinging motion of the bat 20. In the course of swinging the bat, the longitudinal axis "L" of the bat is moved generally through an angle having a vertex near the grip end 24 of the bat. Accordingly, the free end 26 of the bat is the fastest moving part of a swung bat.

In the following description preferred and alternative embodiments of the invention are described as end caps, which may be manufactured separately from the remainder of the bat and subsequently attached to the free end of the bat. As noted above, however, the present invention may also be adapted for use with a single-piece or solid bat, integrally formed with the bat or otherwise fastened thereto. Accordingly, the following references to the inventive end configuration will hereafter be to an end cap embodiment 22, with the understanding that the configuration is not limited to use only with end caps.

Figure 2:
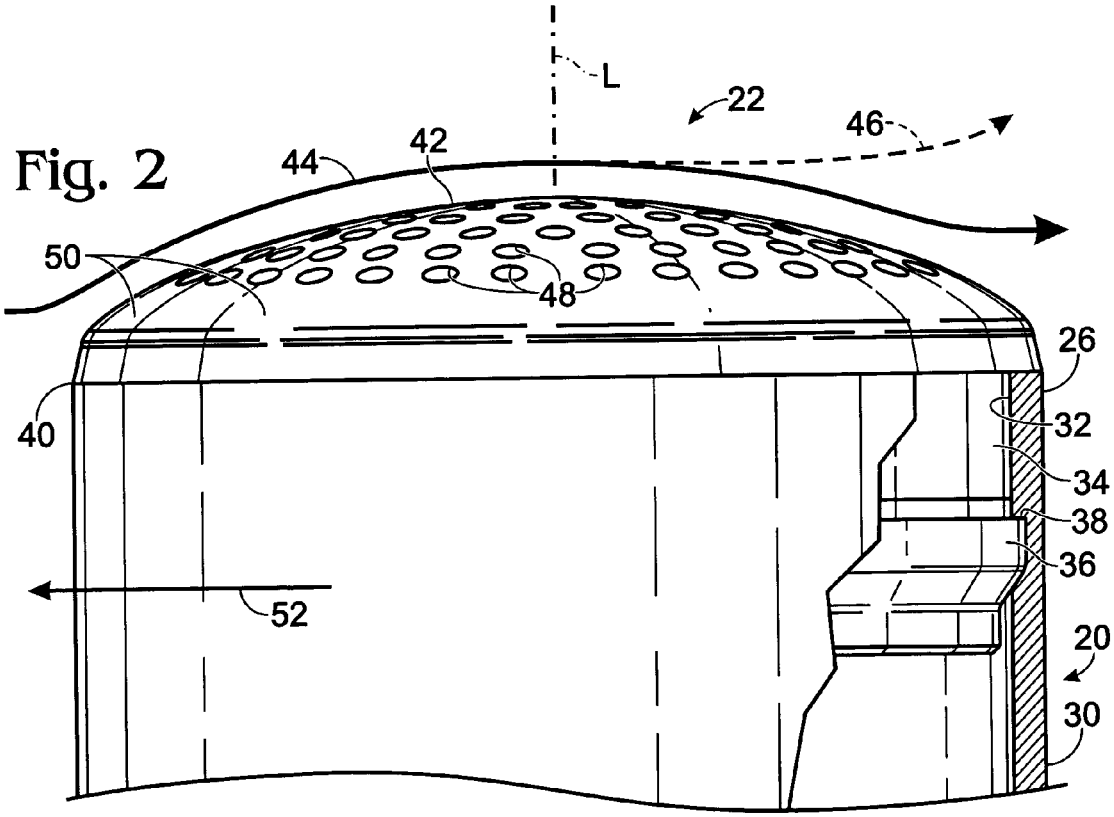
FIG. 2 is an enlarged, detail side view, partly in section, of a bat end configuration in accord with one embodiment of the present invention.

As shown in FIG. 2, the end cap 22 is attachable to the open, free end 26 of the bat. The bat 20 is preferably formed of an aluminum alloy and is hollow at that end 26. The open end 26 thus defines a cylindrical aperture 32 into which the base 34 of the end cap 22 snugly fits. The end cap 22 can be made from any suitable material such as lightweight metal, plastic, or composite. In one embodiment, the base 34 of the end cap is a hollow, cylindrical member having an outside diameter that conforms to the inside diameter of the open, free end 26 of the bat.

The base 34 of the end cap includes a radially projecting lock ring 36 that seats within a correspondingly shaped annular groove formed in the interior surface of the bat. Preferably, the ring is tapered along its innermost end (that is, toward the grip end 24 of the bat) to enable the base 34 to be forced into the hollow, open end of the bat to the depth where the ring 36 can snap into its corresponding groove. When the end cap base 34 is properly attached to the bat, a flat shoulder part 38 of the ring 36 abuts a facing shoulder part of the corresponding groove in the bat to prevent unintended removal of the end cap from the bat.

The attached end cap 22 thus includes an exposed end surface 42 that extends across the free end 26 of the bat from the junction 40 of the cap and remaining part of the bat. In one embodiment, the outer or end surface 42 of the end cap is convexly curved. The FIG. 2 embodiment illustrates this convex curvature as generally dome-shaped and symmetrical about the central longitudinal axis "L" of the bat. The radius of curvature of the exposed end surface of the end cap is about 8 centimeters. As mentioned above, the free end of the bat 20 is the fastest moving part of a swung bat. Accordingly, that part of the bat will normally experience the greatest drag force resisting the swinging force.

The convex shape of the end surface 42 of the cap gives the bat end a more streamlined contour than that of a conventional flat or concave-shaped bat end. Consequently, the convexly contoured shape provides a significant reduction in pressure drag (as compared to those conventional end shapes). In this regard, a boundary layer of air across the end surface 42 remains attached to that end surface to a much greater extent than would occur if the bat end were flat or concave. The outermost part of the boundary layer is illustrated by arrow 44 in FIG. 2.

In addition to the generally streamlined shape of the end cap 22 shown in FIG. 2, the end surface 42 of the cap is roughened to ensure that the boundary layer of the air becomes turbulent across the surface 42, thereby reducing the likelihood that the boundary layer will separate from that surface (such as shown by dashed arrow 46 in FIG. 2), which separation would introduce a significant and undesirable component of pressure drag acting on the bat end.

As used here, the notion of a roughened surface means that the surface departs from an ideal shape (such as a perfectly smooth sphere or dome). The term "textured surface" may be used interchangeably with "roughened surface" in the context of hastening changes in fluid flow from laminar to turbulent.

In one embodiment, the end surface 42 of the end cap 22 is roughened with an array of dimples 48 recessed into that surface. The dimples can be regularly or irregularly spaced and can have any of a variety of shapes. In one embodiment, the dimples are round, having a diameter of about 3.0 mm at the end surface (see FIG. 3) and extending to about 0.6 mm into the surface. The dimples 48 are preferably spaced apart on the end surface by about 2.5 mm.

In one embodiment, a portion 50 of the end surface 42 of the cap 22 is smooth (not roughened). This portion 50 extends between the bat/cap junction 40 and the roughened (dimpled) portion of the surface 42. As the bat is swung, the smooth surface portion 50 helps to ensure that the boundary layer 44 maintains a laminar flow (hence minimizing viscous drag) where the air first contacts the swinging bat (the left-hand side of FIG. 2). Slightly downstream (to the right in FIG. 2) of where the boundary layer 44 encounters the roughened portion 48 of the end surface, the boundary layer flow will become turbulent to retard or eliminate flow separation, thereby minimizing pressure drag, as explained above.

Figure 3:
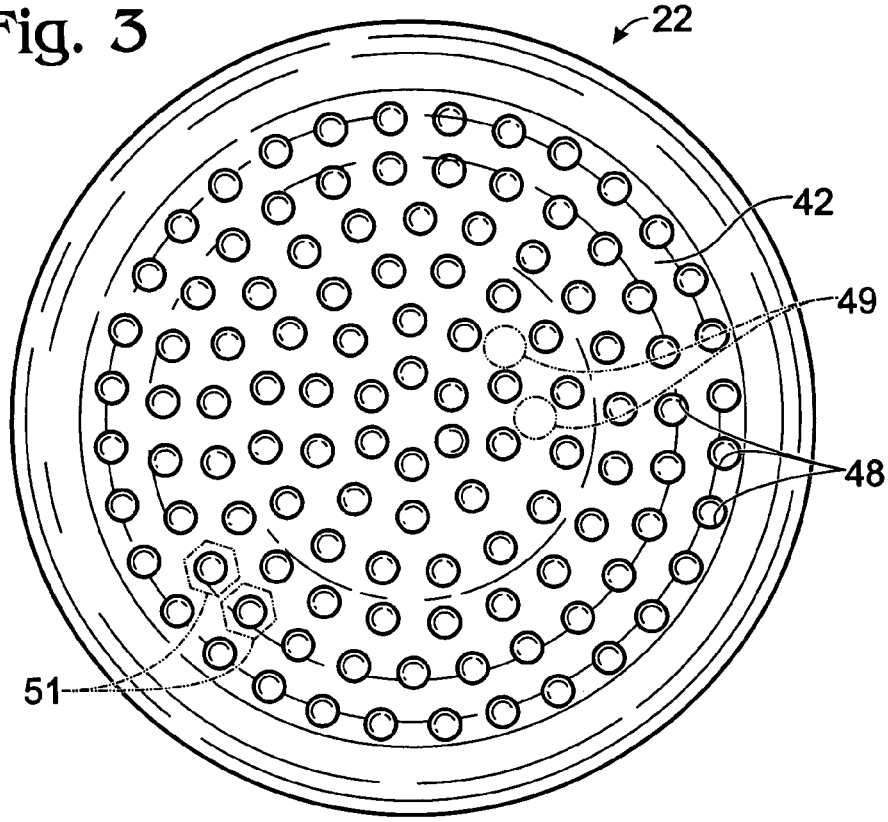
FIG. 3 is a top view of the bat end configuration of FIG. 2.
Figure 4:
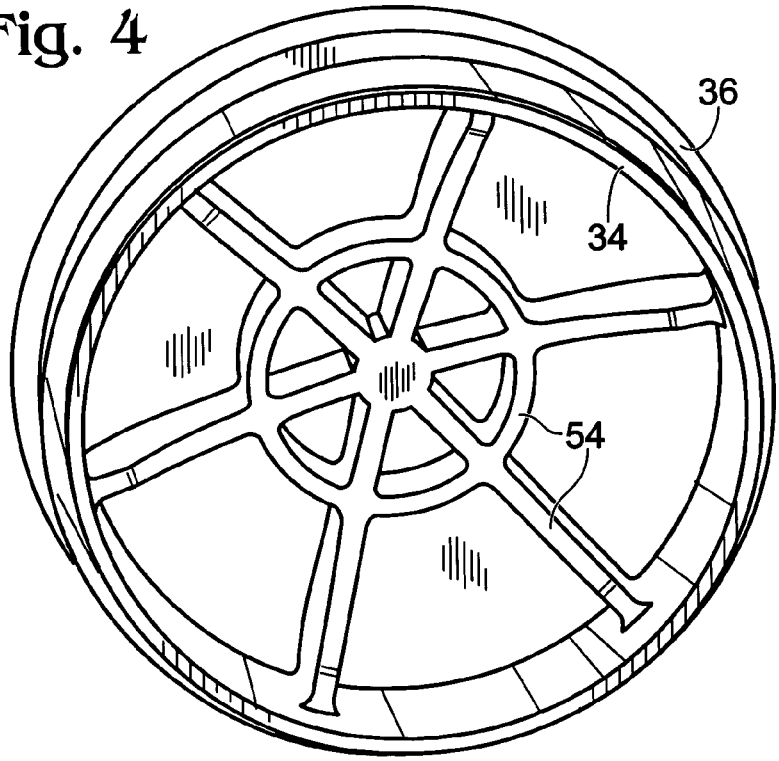
FIG. 4 is a bottom view, in slight perspective, of a bat end cap for attachment to the end of a bat and that carries on its top, exposed end surface the configuration of the present invention.

FIG. 4 illustrates the underside of the end cap 22 of FIGS. 2 and 3. In this embodiment, the end cap is an injection-molded part, including the hollow cylindrical base 34, as well as support ribs 54 integrally formed therewith. It will be appreciated that any of a number of base shapes and configurations might be employed for producing an end cap of sufficient strength, and that is readily attachable to a bat, whether or not the bat has an open end.

Figure 5:
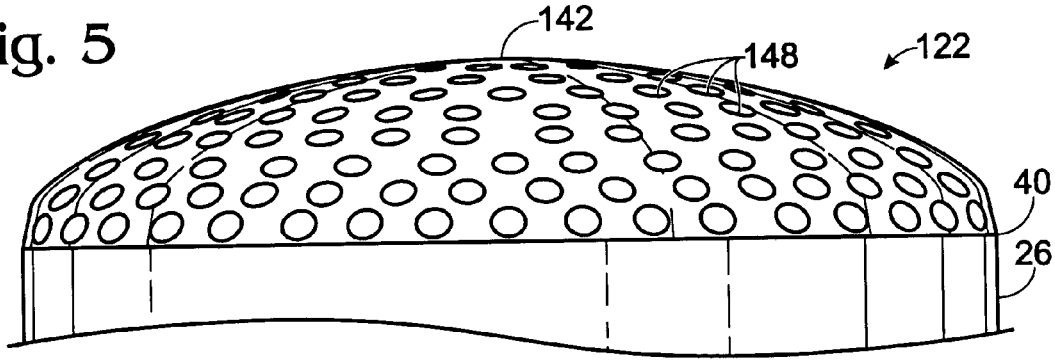
FIG. 5 is a side view that illustrates an alternative embodiment of the bat end configuration of the present invention.

FIG. 5 illustrates another embodiment of an end cap 122 of the present invention that is similar to the embodiment of FIG. 2 but wherein the roughened surface portion 148 covers the entire convexly curved surface 142 of the end cap. The greater areal extent of the roughened portion of this embodiment will enhance the likelihood that a turbulent-flow boundary layer will be generated as the bat is swung. This, in turn, reduces the likelihood that the boundary layer flow will remain laminar over a significant distance across the surface 142 and therefore prone to separation.

Figure 6:
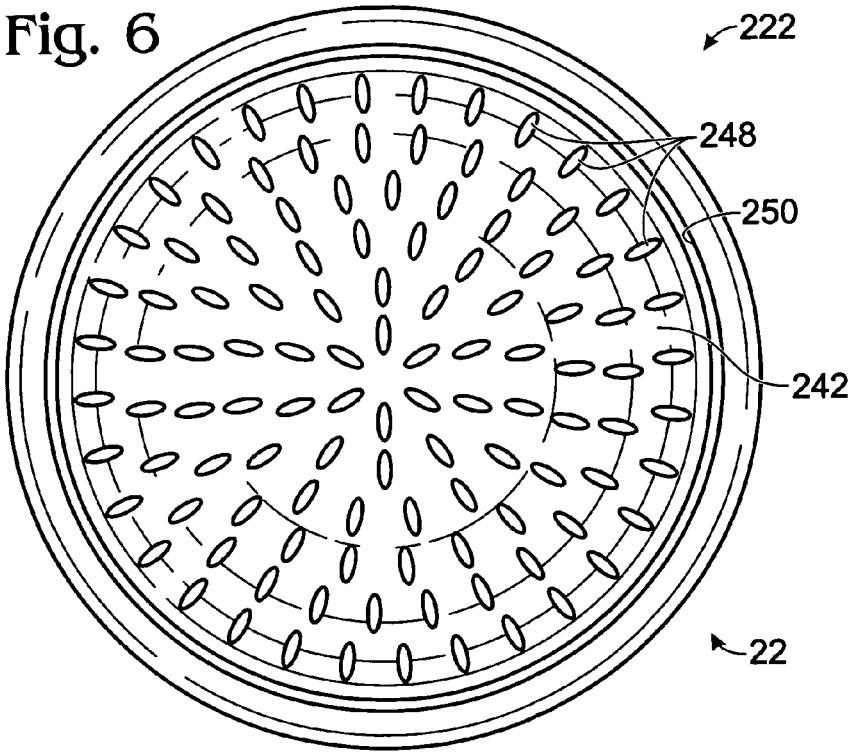
FIG. 6 is a top view that illustrates another alternative embodiment of the bat end configuration of the present invention.

It is noteworthy here that the surface roughening may take any of a variety of forms. For example, when dimples are used, those members need not be circular. FIG. 6 shows another alternative embodiment of the end cap 222 wherein the array of roughening elements 248 are selected to be elongated. Moreover, these elements 248 may be recesses (as are dimples) or protrusions from the contoured surface 242 of the end cap 222. The size of the protrusions (such as the average length and height about surface 248) may vary. For example, the protrusions may be 3 or 4 millimeters long and extend above the end cap surface by 1 or 2 millimeters.

The dimples or protrusions of the foregoing embodiments may be arranged in a regular or irregular array. Moreover, the elements such as dimples or protrusions that create the roughened surface need not all be identical. For example, a portion of the roughened surface in an end cap embodiment can forgo dimples in favor of a trademark or aesthetic feature that is formed in or on the end surface of the end cap. A continuous, shallow groove, such as shown at 250 in FIG. 6 for example, may serve as a roughening element as well as a feature for enhancing the aesthetics of the cap.

FIG. 3 illustrates in broken lines two exemplary alternative surface roughening elements (here dimples 49). Specifically, it is contemplated that dimples 48, 49 can be spaced quite close together, touching or nearly touching one another. The combination of adjacent dimples 48, 49 shown in FIG. 3 also illustrates how dimples of different diameters can be combined on the end surface to increase as desired the extent of roughening of the surface (that is, minimizing the amount of smooth-surface space between roughening elements). The recessed depth of the dimples also may vary among dimples of the same diameter or among dimples of different diameters.

FIG. 3 also illustrates at 51 another alternative configuration of surface roughening elements, which may have a regular polygonal shape. In this alternative, a hexagonal-shaped dimple is illustrated. Such dimples 51 may be aligned to form a configuration resembling a honeycomb. Dimples could also be formed of irregular polygons, irregular curves, or a combination of the two.

It is also contemplated that a bat end configuration in accordance with the present invention may have enhanced streamlining, as discussed next in connection with the end cap embodiment 322 illustrated in FIG. 7. Specifically, the end cap 322 of this embodiment is intended to be "directional," in the sense that the bat (and attached end cap 322) is held in a particular way so that when swung (such that the bat end moves from right to left in FIG. 7), one edge (a leading edge 346) of the end cap will lead the end cap through the air, and the opposite edge of the end cap (the trailing edge 347) will trail. The bat is thus held at a particular orientation relative to a batter's hands, in much the same way wooden bats are held ("label up") so that as the bat nears the ball it is swung in a plane roughly parallel to the grain of the wood of the bat.

Figure 7:
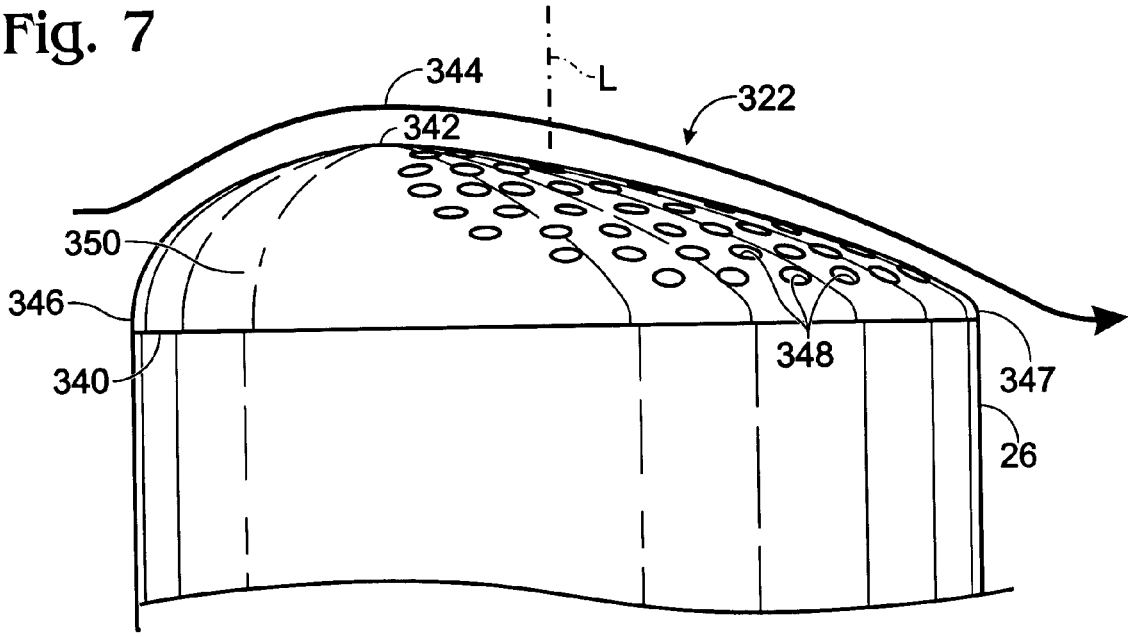
FIG. 7 is a side view that illustrates another alternative embodiment of the bat end configuration of the present invention.

With a leading edge 346 of an end cap 322 so designated, it can be appreciated that the contoured end surface 342 is made quite streamlined, as shown in FIG. 7. Specifically, the end cap surface 342 has a semi-teardrop or airfoil shape, such that the radius of curvature of the surface becomes increasingly large (the curve flattens) in the direction of the trailing edge 347 of the end cap, thereby to ensure that the boundary layer 344 remains attached to the end cap across the entire end surface 342.

It is contemplated that any of a variety of streamlined or "directional" end cap shapes may be employed. Such shapes can be characterized in a generic sense as ones that are configured and arranged to be asymmetrical about the central longitudinal axis "L" of the bat to which the end cap is attached. An asymmetrical end cap like the one 322 of FIG. 7 can be attached to the bat in a manner that permits, with effort, the periodic rotation of the end cap about the bat end for repositioning the leading edge of the cap relative to the bat. Accordingly, different parts of the bat barrel will contact the ball over time. This repositioning aspect thus promotes somewhat uniform wear of the bat.

It is also contemplated that a more streamlined end cap 322 as shown in FIG. 7 having an entirely smooth end surface 342 may result in a laminar-flow boundary layer that does not separate from the cap, thus obviating the need for roughening the end cap surface. Alternatively, a portion 350 of that surface in the vicinity of the leading edge 346 may remain smooth while a downstream portion 348 is roughened in a manner as described above. The entire surface 342 may be roughened, if desired. It is also contemplated that the surface portion near the leading edge 346 of the cap can be roughed to initiate a transition of the boundary layer from laminar to turbulent flow and made smooth downstream of that roughened portion (that is, where the boundary layer is turbulent) to minimize vicious drag on the end surface. The notion of a smooth surface located downstream of the roughened surface (that is, relative to the direction of air flow across the end cap) is discussed more below in connection with FIG. 9.

Figure 8:
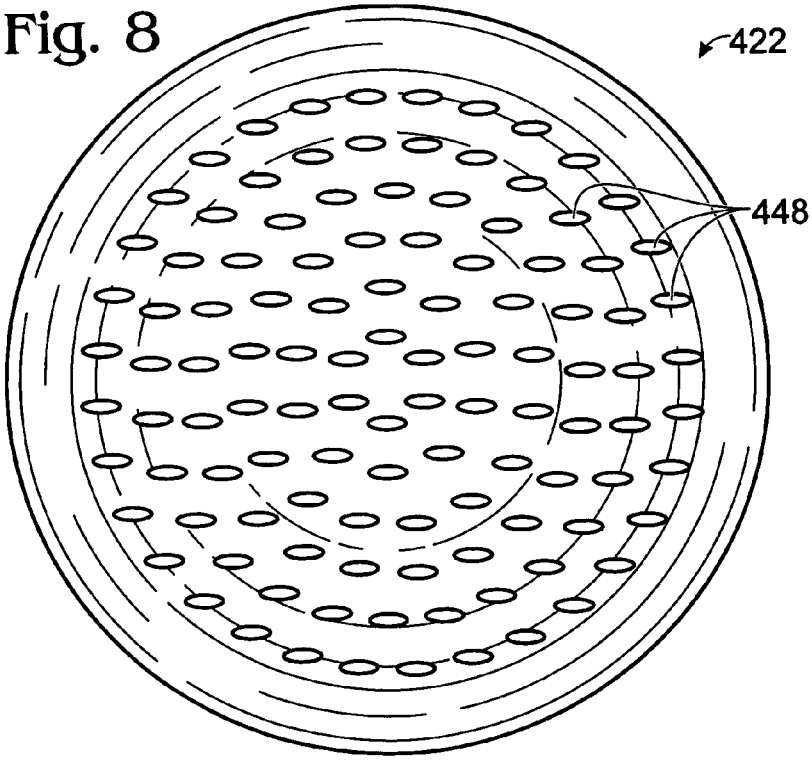
FIG. 8 is a top view that illustrates yet another alternative embodiment of the bat end configuration of the present invention.

As mentioned above, the elements, such as dimples and protrusions that are used to roughen the end cap surface may be arranged in regular or irregular arrays. In one embodiment of an end cap 422, (FIG. 8) it is contemplated that elongated dimples or protrusions 448 may be arranged with their long axes parallel to one another and, preferably, parallel to the direction the bat is swung. Such an arrangement is useful for introducing a small amount of turbulence into the boundary layer to avoid the flow separation problems attendant with laminar flow, while preventing the generation of excessive turbulence in the boundary layer since a viscous drag component would increase as the turbulence (turbulent boundary layer thickness) increases.

Figure 9:
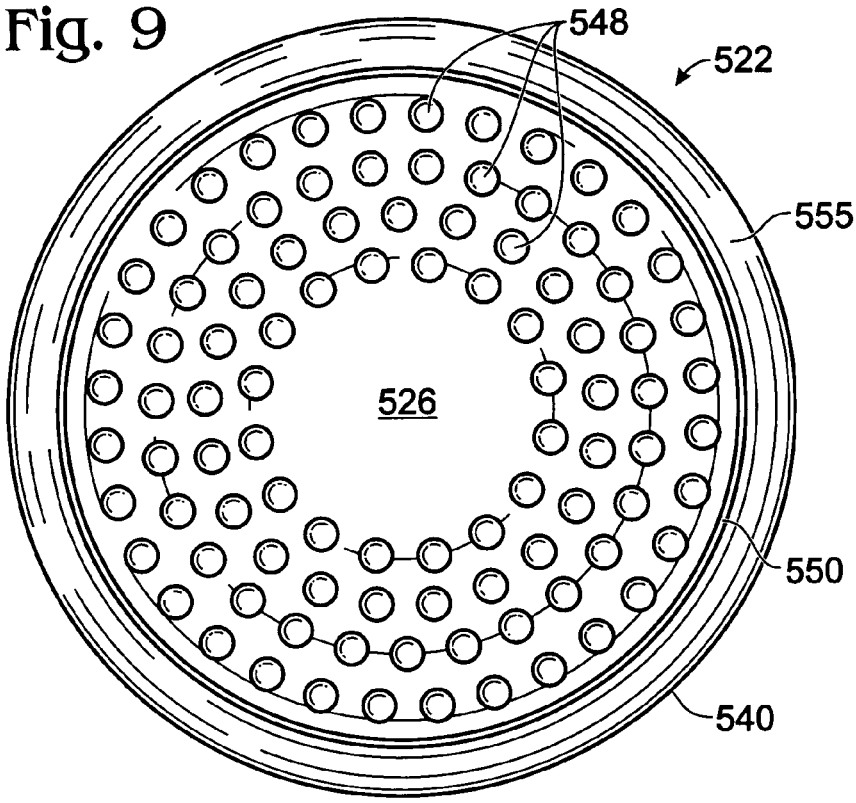
FIG. 9 is a top view that illustrates another alternative embodiment of the bat end configuration of the present invention.

The end cap configuration 522 illustrated in FIG. 9 includes on the convexly curved end surface a roughened portion that comprises an annular shaped array of elements, such as dimples 548. This roughened portion surrounds the relatively smooth tip area 526 of the bat end. An optional, shallow, continuous groove 550 is formed in the end surface and located adjacent to the array 548 and radially outward therefrom. Preferably, a smooth portion 555 of the end surface extends between the groove 550 and the bat/cap junction 40, which is illustrated in FIG. 2.

The width (measured radially) of the annular shaped array of roughening elements 548 is selected to "trip" the boundary layer to ensure that the boundary layer transitions from laminar to turbulent flow as the bat is swung. In a preferred embodiment, this width is made to generally match the diameter of the circular, smooth tip area 526, as viewed in plan (FIG. 9). Once the boundary layer becomes turbulent (for reducing or eliminating the effects of pressure drag, as discussed above), additional downstream surface roughness provides no further benefit in terms of reducing the pressure drag. Rather, additional downstream surface roughness would increase viscous drag, as compared to a smoother surface. Consequently, having the relatively smooth surface area 526 downstream of the roughened area 548 (that is, beyond the point where the boundary layer is tripped into turbulent flow) will minimize the overall aerodynamic drag on the end cap. In a preferred embodiment the roughening elements 548 are circular dimples formed in the end surface of the end cap 522. The diameters of the dimples (that is, as measured at the surface of the cap) are about 3 mm, and they extend into the end surface by to a depth of about 1 mm.

Figure 10:
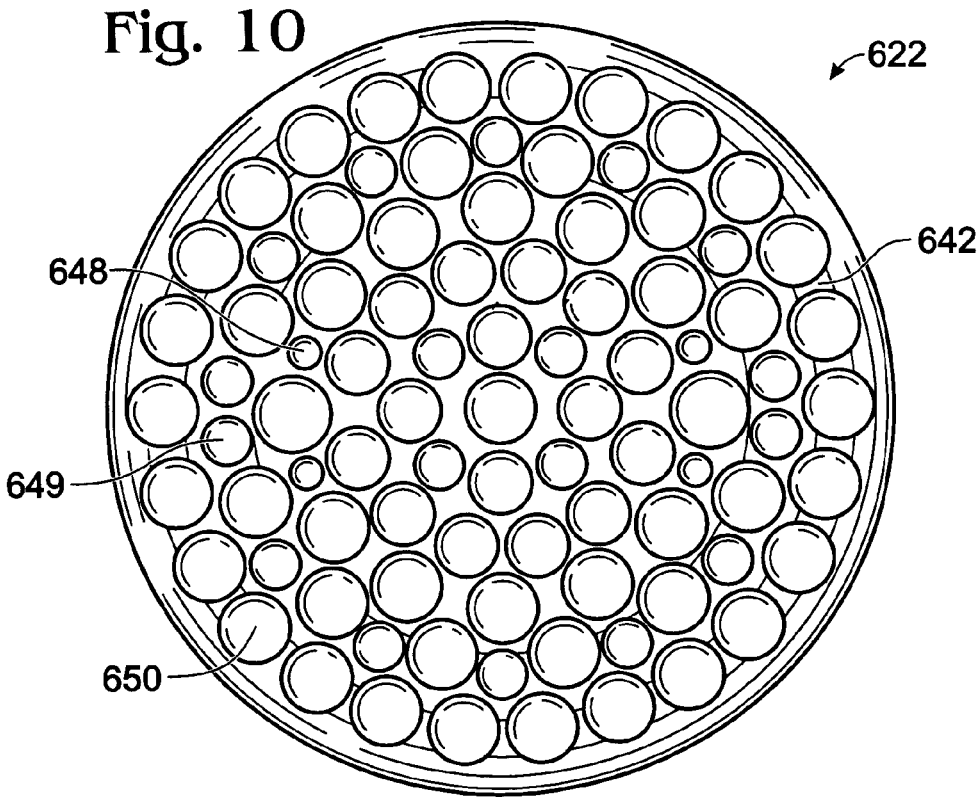
FIG. 10 is a top view that illustrates yet another alternative embodiment of the bat end configuration of the present invention.

FIG. 10 illustrates another end cap embodiment 622 wherein the end surface 642 is substantially covered with an array of roughening elements (here, dimples) having different diameters. In this embodiment the dimples 648, 649, 650 range from 3 to 6 mm in diameter and are applied in the pattern illustrated in FIG. 10. Preferably, all of the dimples extend into the end surface by a uniform amount. In this embodiment, that depth is about 0.5 mm. It is contemplated that the dimples 548 that make up the annular shaped roughened portion illustrated in FIG. 9 could also be dimensioned as just noted with respect to the dimples of the FIG. 10 embodiment.

Having here described embodiments of the present invention, it is noted that the spirit and scope of the invention is not limited to those embodiments, but extend to the various modifications and equivalents of the invention defined in the appended claims.

The invention claimed is:

1. An end cap for a bat, comprising:

a base that is shaped to attach to one end of the bat, thereby to attach the end cap to the bat;

a convexly contoured end surface that is exposed when the end cap is attached to the bat; wherein the end surface has a roughened portion and a smooth portion, the roughened portion having an annular shape comprising an annular array of dimples in the end surface that surrounds a smooth portion in the center of the end surface.

2. The end cap of claim 1 wherein the roughened portion also comprises a continuous groove in the end surface located adjacent to the array of dimples.

3. The end cap of claim 1 wherein the dimples are each about 3 mm in diameter and about 1 mm deep in the end surface.

4. An end cap for an elongated bat, comprising:

a base that is shaped to attach to the end of the bat thereby to attach the end cap to the bat;

a contoured end surface that is exposed when the end cap is attached to the bat, the contoured end surface of the attached end cap being asymmetrical about the longitudinal axis of the bat and having a leading edge and a trailing edge, the end surface being smooth but for a roughened portion of the end surface away from the trailing edge.

5. The end cap of claim 4 wherein the roughened portion of the end surface is roughened with dimples.

6. The end cap of claim 5 wherein the sizes of the dimples vary within the roughened portion.

7. The end cap of claim 4 wherein the roughened portion of the end surface is roughened with protrusions from the end surface.

8. The end cap of claim 4 wherein the base is configured to fit into an open end of a bat.

9. The end cap of claim 4 further comprising a bat to which the end cap is attached.

10. An end cap for an elongated bat, comprising:

a base that is shaped to attach to the end of the bat thereby to attach the end cap to the bat;

a contoured end surface that is exposed when the end cap is attached to the bat, the contoured end surface of the attached end cap being asymmetrical about the longitudinal axis of the bat, wherein the contoured end surface has a leading edge and a trailing edge and the position of the end cap is adjustable relative to the open end of the bat, thereby to permit variation in the location of the leading edge relative to the bat.

11. A bat having a longitudinal axis and an aerodynamic end configuration, comprising:

a handle end and an opposite free end and a smooth outer surface along the length of the bat between the opposite ends such that a barrel portion of the bat used for striking a ball has a smooth surface; wherein the free end of the bat includes an exposed convexly contoured end surface having a portion that is roughened with an array of dimples, the array covering less than the entire convexly contoured end surface.

12. The bat of claim 11 wherein the roughened portion of the end surface has an annular shape that surrounds a central smooth portion of the end surface.

13. The bat of claim 12 wherein the radial width of the annular array of dimples substantially matches the diameter of the surrounded central smooth portion of the end surface.

14. The bat of claim 11 wherein the roughened portion also comprises a continuous groove in the end surface located adjacent to the array of dimples.

15. The bat of claim 11 wherein the dimples are each about 3 mm in diameter and about 1 mm deep in the end surface.

16. The bat of claim 11 wherein the diameters of the dimples as measured at the end surface varies across the roughened portion.

17. The bat of claim 16 wherein the diameters vary between about 3 mm to about 6 mm.

18. The bat of claim 16 wherein the dimples of the array all have substantially the same depth into the end surface.

19. The bat of claim 18 wherein the depth of all of the dimples is about 0.5 mm.

20. The bat of claim 11 wherein the free end of the bat comprises an end cap that is attached to the remaining part of the bat.

21. The bat of claim 20 wherein the dimples have a length dimension and are arranged to be substantially parallel to one another.

* * * * *